US005123405A

United States Patent [19]

McShirley et al.

[11] Patent Number: 5,123,405

[45] Date of Patent: Jun. 23, 1992

[54] HANDLE FOR HIGH FREQUENCY SONIC MASSAGER

[75] Inventors: Richard McShirley, Santa Clarita; Robert McShirely, Valencia, both of Calif.

[73] Assignee: McShirley Products, Inc., Valencia, Calif.

[21] Appl. No.: 676,710

[22] Filed: Mar. 28, 1991

[51] Int. Cl.[5] ..... A61H 1/00

[52] U.S. Cl. ..... 128/24 R; 128/32; 128/36

[58] Field of Search ..... 128/32, 24.1, 24 R, 128/36, 41, 67, 58-62 R, 63

[56] References Cited

U.S. PATENT DOCUMENTS 3,364,921 1/1968 Reiter ..... 128/32

4,508,108 4/1985 Miyaoka ..... 128/62 R

*Primary Examiner*—Robert A. Hafer

*Assistant Examiner*—David Kenealy

*Attorney, Agent, or Firm*—Blakely, Sokoloff, Taylor & Zafman

[57] ABSTRACT

A hand held electronic massager with a retractable handle. The handle provides an extension for the unit so that the vibrating surface can reach more remote locations. The massager has a vibrating motor attached to a power cord by an "on/off" switch, all concealed and supported by a housing. The vibrating motor has a vibrating surface at one end of the housing, adapted to massage the muscles of the user when the surface is pressed against the user's skin. At the other end of the housing is an opening that allows a handle to slide in and out of the housing between an extended and a retracted position. The handle is captured by the housing, so that the handle cannot slide completely in or out of the housing.

10 Claims, 2 Drawing Sheets

HANDLE FOR HIGH FREQUENCY SONIC MASSAGER

BACKGROUND OF THE INVENTION

1. FIELD OF THE INVENTION

The present invention relates to hand held electric massage units that are typically applied to a user's skin.

2. DESCRIPTION OF RELATED ART

Massaging techniques have long been used to loosen and relax human muscles. Massages are typically performed by a masseur who provides a manual rub down. Hiring a masseur is usually expensive and impractical. As an alternative, hand held electronic vibrational massagers have been developed to allow the user to massage himself in the privacy of his own home. Such massagers are commonly used on the back area, wherein it is difficult to reach the middle portions of the back. One obvious solution is to make the massager longer so that it can extend down the length of the back. The problem with a long massager is that the unit needs a large amount of space for storage. A large unit is also more difficult to package and distribute for sale. It is also preferable to make the massager portable so that the user can carry the unit around with him, especially when travelling. It would therefore be desirable to have a hand held electronic vibrational massager unit that was compact, yet still capable of reaching every area of a persons body.

SUMMARY OF THE INVENTION

The present invention is a hand held electronic massager with a retractable handle. The handle provides an extension for the unit so that the vibrating surface can reach more remote locations. The massager has a vibrating motor attached to a power cord by an "on/off" switch, all concealed and supported by a housing. The vibrating motor has a vibrating surface at one end of the housing, adapted to massage the muscles of the user when the surface is pressed against the user's skin. At the other end of the housing is an opening that allows a handle to slide in and out of the housing, between an extended and a retracted position. The handle is captured by the housing, so that the handle cannot slide completely in or out of the housing. The handle thus being attached to the housing and accessible to the user at all times. The housing is shaped so that it can be easily grasped by a human hand.

The massager can be operated by either holding the housing, or by pulling out and grabbing the handle so that the vibrating surface can be extended onto more remote locations of the human body. The handle can be pushed back into the housing so that the massager is portable and can be easily packed, shipped and stored.

Therefore it is an object of this invention to provide a hand held electronic vibrating massager that has a retractable handle that can be extended to increase the range of the massager.

DETAILED DESCRIPTION OF THE DRAWINGS

The objects and advantages of the present invention will become more readily apparent to those skilled in the art after reviewing the following detailed description and accompanying drawings, wherein.

DETAILED DESCRIPTION OF THE INVENTION

Figure 1:
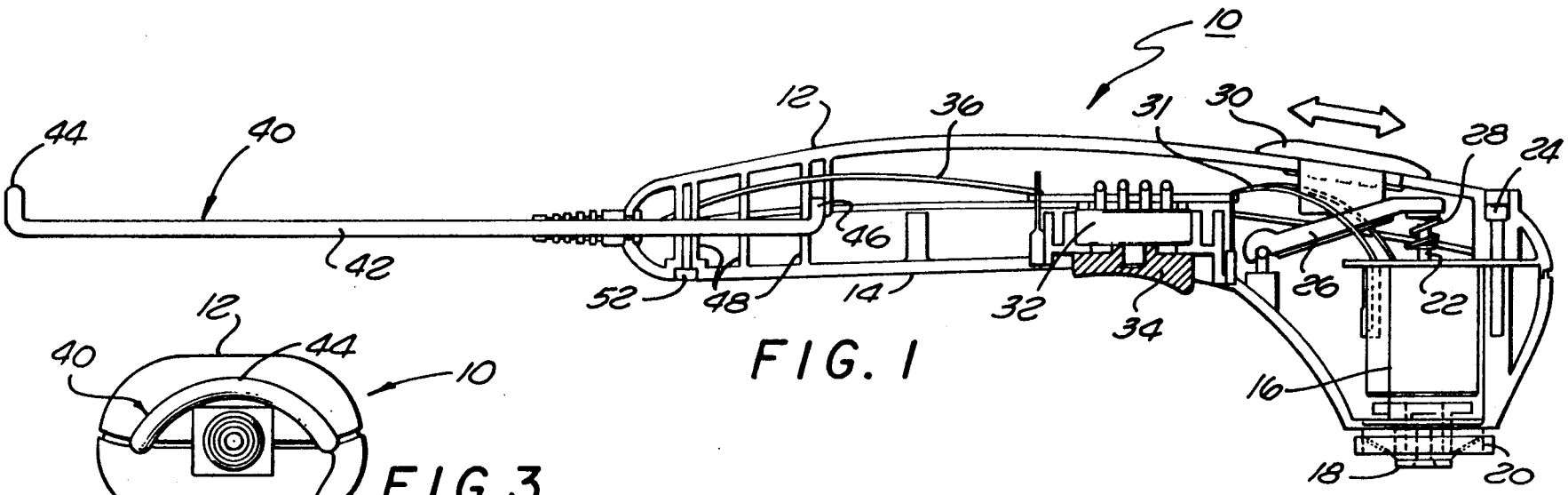
FIG. 1 is a cross-sectional side view of an electronic massager of the present invention, showing a retractable handle in the extended position.
Figure 2:
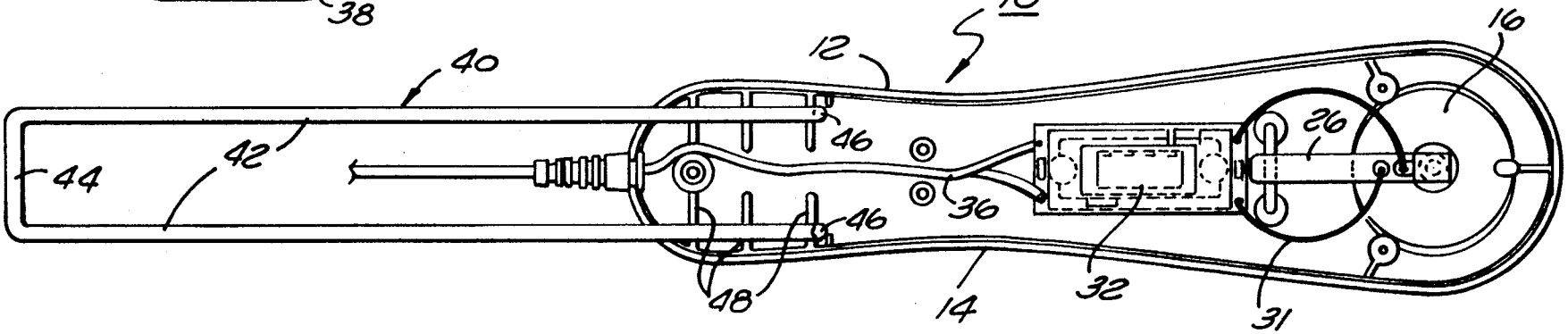
FIG. 2 is a cross-sectional top view of FIG. 1.

Referring to the drawings more particularly by reference numbers, FIGS. 1 and 2 show a massager 10 of the present invention. The massager 10 has a housing 12 that is preferably constructed from plastic to be both light and durable. The housing 12 has a handle portion 14 with a radius along the top and sides of the housing 12, to allow a human hand to easily grasp the massager 10. At one end of the massager is a motor 16 that vibrates a massage pad 18. The massage pad 18 is typically rubber or another soft material that can be pressed against the users skin to vibrate and rub the area of contact. The pad 18 is attached to a plate 20 that is connected to a shaft 22 that extends through the motor 16. The shaft 22 is connected to a spring (not shown), wherein the motor 16 excites the shaft 22 and resonates the plate 20 and pad 18. The motor 16 is rigidly attached to the housing by screw 24.

In the preferred embodiment the massager 10 has a lever 26 pivotally attached to the housing 12. The lever 26 is attached to the shaft 22, through a spring 28 that is in series with the spring around the shaft 22. A control cam 30 abuts against the lever 26 and is attached to the housing 12, so that the cam 30 can be moved in the directions indicated by the arrows. Moving the cam 30 rotates the lever 26 and changes the spring rate of the spring 28, wherein the user can control the vibrational intensity of the pad 18. A pair of wires 31 connect the motor 16 to a switch 32 with a trigger 34, that allows the user to turn the motor 16 on and off. Attached to the switch 32 is a power cord 36 with a plug (not shown) that can connect the switch 32 and motor 16 to an electrical power source, which is typically an electric wall socket. The massager 10 can therefore be used in any location where there is an electrical outlet.

Figure 3:
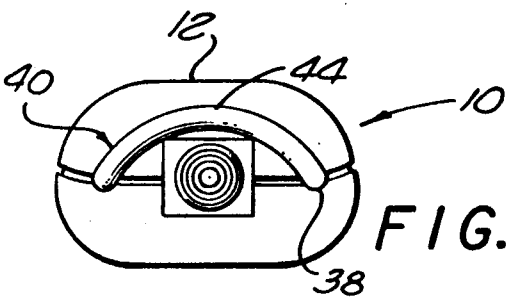
FIG. 3 is an end view of FIG. 1.
Figure 4:
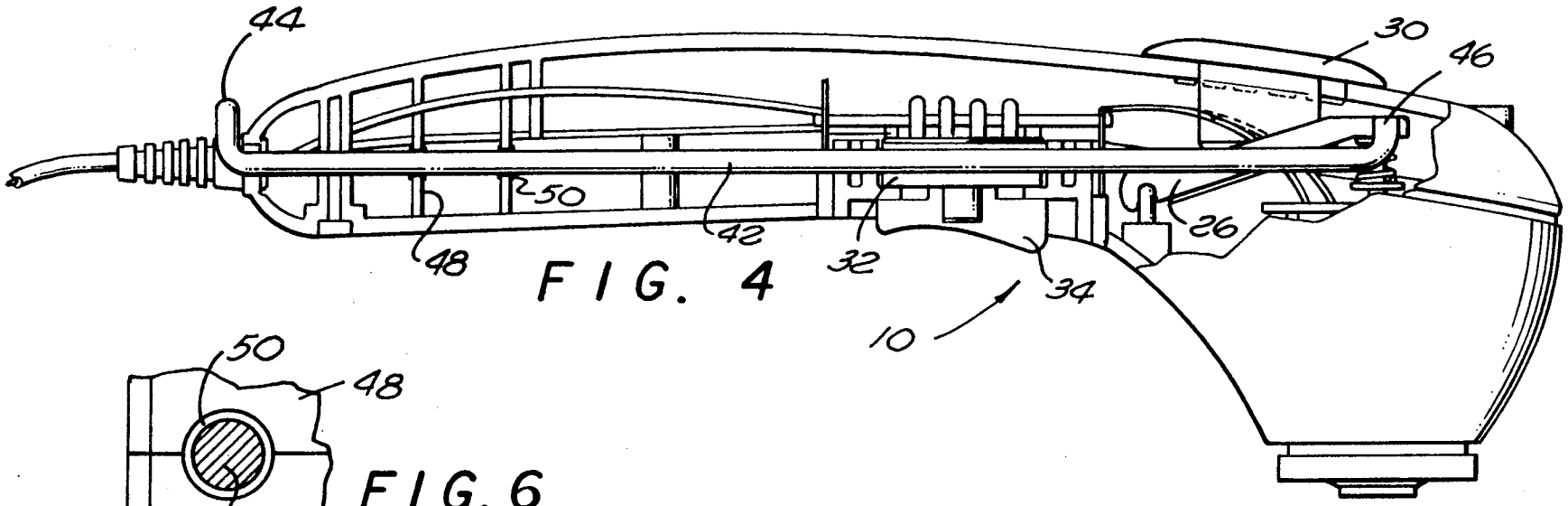
FIG. 4 is a cross-sectional side view of the massager shown in FIG. 1 with the handle in a retraced position.
Figure 5:
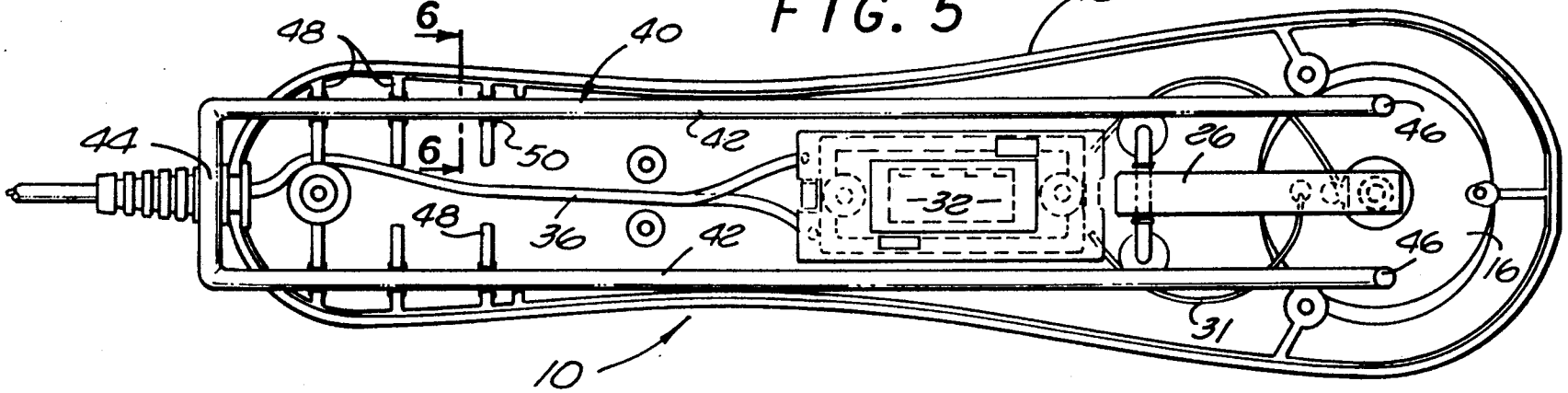
FIG. 5 is a cross-sectional top view of FIG. 4.

As shown in FIG. 3 the housing 12 has a slot 38 along the back end, so that an extension handle 40 may slide in and out of the housing 12. The handle 40 is shaped like a C, with a pair of essentially parallel leg portions 42 that extend from a base portion 44. The base portion 44 is constructed in an arc as shown in FIG. 3. The end 46 of each leg portion 42 is bent at a right angle as more clearly shown in FIG. 1. The handle 40 is preferably manufactured as a single metal rod bent into the configuration shown. The housing 12 has three ribs 48 with holes that allow the leg portions 42 to slide through the housing 12. The ribs 48 both support and guide the leg portions 42 as the handle 40 is moved between the extended position as shown in FIGS. 1 and 2, and the retracted position as shown in FIGS. 4 and 5. The massager 10 can be packaged and stored while the handle 40 is in the retracted position. When the user is unable to comfortably place the vibrating pad 18 in a certain area, such as the middle of the back, the handle 40 can be pulled out into the extended position to provide the massager 10 with a longer reach. The handle 40 can be pulled until the end 48 of the leg portions 42 abut against the first rib 48, which stops any further movement of the handle 40. The rib 48 captures the handle 40 so that it cannot fall out or be removed from the massager 10. When the handle 40 is no longer needed, it can be pushed back into the housing 12 until the base portion 44 makes contact with the housing 12. The base portion 44 prevents the handle 40 from going completely inside the housing 12, so that the handle 40 is always easily accessible.

Figure 6:
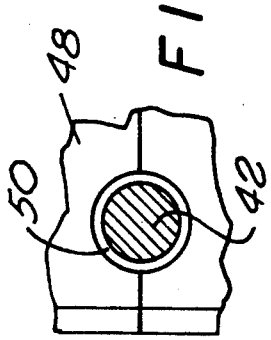
FIG. 6 is a sectional view taken at line 6—6 of FIG. 5, showing a rubber grommet that supports and guides the handle.

The ribs 48 are preferably constructed to have a tight fit with the leg portions 42, so that the handle 40 does not rotate within the housing 12. The tight fit between the handle 40 and ribs 48 prevents the leg portions 42 from hitting and damaging the wires, switch or electric motor when in the retracted position. To insure such a tight fit, rubber grommets 50 may be placed in the holes of the ribs 48 as shown in FIG. 6. The frictional force between the grommets 50 and handle 40 may be such that the housing 12 will not slide down the handle 40 when the massager is in a vertical position. The grommets 50 could keep the handle 40 in place in a intermediate position between the extended and retraced positions. The housing 12 is preferably constructed from two pieces that are attached by screw 24 and a second screw 52. The two piece housing allows the handle 40 to be placed inside the massager before the housing halves are attached, providing for easy assembly of the massager unit.

While certain exemplary embodiments have been described in detail and shown in the accompanying drawings, it is to be understood that such embodiments are merely illustrative of an not restrictive on the broad invention, and that this invention not be limited to the specific constructions and arrangements shown and described, since various other modifications may occur to those ordinarily skilled in the art.

What is claimed is:

1. A hand held vibrational massager, comprising:

a housing;

a vibrating unit attached to said housing, said vibrating unit has a vibrating surface adapted to provide a vibrational force to a working surface adjacent said vibrating surface;

power transmission means operatively connected to said vibrating unit for providing power said vibration unit;

a switch attached to said housing and operatively connected to said vibrating unit and power transmission means that provides power to said vibrating unit when said switch is in an open position; and a C-shaped hand operatively connected said housing, said handle and said housing being constructed such that said handle can slide in and out of said housing between extended and retracted positions, said handle having two essentially parallel leg portions that extend from a base portion, said base portion being shaped in an arc such that said base portion can abut against said housing and prevent said handle from sliding further into said housing when said housing is in said retracted position, said leg portions having ends that project outward from said leg portions such that said ends can abut against said housing and prevent said handle from sliding further out of said housing when said housing is in said extended position.

2. The massager as recited in claim 1, wherein said housing has at least one internal rib that supports and guides said handle within said housing, said rib providing a stop for said handle so that said handle cannot be pulled out of said housing.

3. The massager as recited in claim 2, wherein said rib has a grommet surrounding said handle, wherein said grommet applies a frictional force to said handle such that a predetermined force must be applied to said handle to move said handle within said housing.

4. The massager as recited in claim 2, wherein said housing has three ribs that guide and support said handle.

5. The massager as recited in claim 1, wherein said power transmission means is a cord attached to said housing and said switch means, said cord being adapted to plug into an electrical socket to provide power to said vibrating unit.

6. The massager as recited in claim 1, further comprising means to vary said vibrational force of said vibrating unit.

7. A hand held vibrational massager, comprising:

a C shaped handle having a pair of essentially parallel leg portions that extend from a base portion, said base portion being shaped in an arc that extends along a plane essentially perpendicular to said leg portions, said leg portions having ends that protrude in an outward direction essentially perpendicular to said leg portions;

a housing that captures said handle, said housing having an opening so that said handle can slide in and out of said housing between extended and retracted positions, said opening constructed such that said base portion of said handle cannot be inserted into said housing, said housing further having at least one rib that guides and supports said handle as said handle is moved between said extended and retracted positions, said rib being adapted to abut against said protruded ends of said handle and prevent said handle from being pulled out of said housing;

a vibrating unit attached to said housing, said vibrating unit has a vibrating surface adapted to provide a vibrational force to a working surface adjacent said vibrating surface;

a cord attached to said housing and said vibrating unit, adapted to plug into an electrical socket to provide power to said vibrating unit; and, a switch attached to said housing and operatively connected to said vibrating unit and said cord, that provides power to said vibrating unit when said switch is in an open position.

8. The massager as recited in claim 7, further comprising means to vary said vibrational force of said vibrating unit.

9. The massager as recited in claim 8, wherein said housing has three ribs that guide and support said handle.

10. The massager as recited in claim 9, wherein said ribs have grommets surrounding said handle, wherein said grommet apply a frictional force to said handle such that a predetermined force must be applied to said handle to move said handle within said housing.

* * * * *